US005381560A

United States Patent [19]

Halstead

[11] Patent Number: 5,381,560

[45] Date of Patent: Jan. 17, 1995

[54] FITTING AND RETENTION SYSTEM FOR HEADGEAR

[75] Inventor: Peter D. Halstead, Seymour, Tenn.

[73] Assignee: PDH Corporation, Knoxville, Tenn.

[21] Appl. No.: 36,046

[22] Filed: Mar. 23, 1993

[51] Int. Cl.[6] ..... A42B 3/08

[52] U.S. Cl. ..... 2/421

[58] Field of Search ..... 2/410, 425, 421, 422, 2/417, 418, 420, 183, 411

[56] References Cited

U.S. PATENT DOCUMENTS

| | | | |
|---|---|---|---|
| 2,739,310 | 3/1956 | Frieder et al. | 2/418 |
| 4,075,715 | 2/1978 | Cowgill | 2/421 |
| 4,884,301 | 12/1989 | Aileo | 2/421 |
| 5,023,958 | 6/1991 | Rotzin | 2/421 |
| 5,083,320 | 1/1992 | Halstead | 2/413 |
| 5,121,508 | 6/1992 | Grilliot et al. | 2/421 |
| 5,129,108 | 7/1992 | Copeland et al. | 2/424 |
| 5,142,705 | 9/1992 | Edwards | 2/418 |
| 5,168,576 | 12/1992 | Krent et al. | 2/2 |

FOREIGN PATENT DOCUMENTS

| | | | |
|---|---|---|---|
| 1172388 | 11/1969 | United Kingdom | 2/421 |

*Primary Examiner*—Clifford D. Crowder
*Assistant Examiner*—Michael A. Neas
*Attorney, Agent, or Firm*—Luedeka, Neely & Graham

[57] ABSTRACT

A system for fitting headgear, such as a bicycle helmet, to the head of a user without requiring fit or sizing pads. The fit system includes an elongate fitting structure having a middle portion and a pair of opposed ends. The opposed ends are attached to the headgear in a tensioned state so that the middle portion surrounds at least a portion of the occipital protuberance and the tension in the strap maintains the headgear closely adjacent the cranium. In addition, compatible retention systems are disclosed for helping to maintain the helmet on the head of the user.

4 Claims, 6 Drawing Sheets

FITTING AND RETENTION SYSTEM FOR HEADGEAR

TECHNICAL FIELD

This invention relates in general to headgear. More particularly, the invention relates to a system for fitting and securing a protective helmet to the head of a user.

BACKGROUND OF THE INVENTION

Headgear such as protective helmets are often worn during participation in activities where there is a risk of injury. For example, bicycle riding, skating, and hockey are activities in which the participant often wears a protective helmet to reduce the risk of injury in the event of a mishap.

Protective helmets are typically available in standard sizes, e.g. small, medium and large, and are formed of lightweight, rigid materials. For example, one type of bicycle helmet has a rigid, generally oval, polystyrene inner liner and a hard plastic outer liner. Unless custom made, however, such helmets do not precisely or snugly fit all users within a standard size designation. To account for this, typical helmets are sold with interchangeable fit or sizing pads so that the wearer may adjust the fit of the helmet.

Fit pads are typically foam rubber sections that releasably attach, as by hook and loop material, at various locations to the interior of the helmet. Sets of interchangeable pads of different thickness are provided so that the wearer may select the combination which provides the best fit. Fit pads are undesirable because they are cumbersome, wasteful, and do not provide a satisfactory fit in many instances. Moreover, even when a good fit is achieved, the fit pads offer minimal resistance to slippage between the helmet and the head of the user, especially when the user's head is tilted forward as often occurs during bicycling, or when the user experiences vibratory motion as when riding on rough terrain, or when the user engages in acrobatic activities.

SUMMARY OF THE INVENTION

Accordingly it is an object of the present invention to provide a fit system for headgear that facilitates fitting of the headgear to craniums of various size and shape without requiring interchangeable fit pads of various thicknesses.

Another object of the present invention is to provide a fit system of the character described which resists slippage between the helmet and the cranium of the user to help maintain the helmet in a desired position.

An additional object of the present invention is to provide a fit system of the character described that may be used with existing helmets.

A further object of the present invention is to provide a fit system of the character described in combination with a retention system for securing the helmet on the head of the user.

A still further object of the present invention is to provide a fit system and helmet of the character described which is lightweight and comfortable.

Still another object of the present invention is to provide a fit system and helmet of the character described which is inexpensive and uncomplicated in configuration.

Having regard to the foregoing objects, the present invention is directed to a system for fitting headgear to a cranium having an occipital protuberance. The system includes an elongate fitting structure for fitting the headgear to the cranium, the fitting structure is provided by a strap having a middle portion and a pair of opposed ends; and attachment structure for attaching the opposed ends to the headgear in a tensioned state so that the middle portion surrounds and is closely adjacent at least a portion of the cranium on or below the occipital protuberance and the tension in the strap maintains at least a portion of the headgear closely adjacent the cranium.

In another aspect, the present invention provides a helmet which includes a liner having an inner surface corresponding substantially in size and shape to a human cranium, structure for fitting the liner to the cranium, the structure having a middle portion and a pair of opposed ends, and structure for attaching the opposed ends to the liner in a tensioned state so that the middle portion fittingly engages at least a portion of the cranium on or below the occipital protuberance of the cranium to maintain at least a portion of the inner surface of the liner closely adjacent the cranium.

The fit system enables the fit of the helmet to be easily and quickly adjusted without the use of interchangeable fit pads. In addition to this advantage, the positioning of the strap snugly against the occipital protuberance is also advantageous to help retain the helmet on the cranium even when the cranium is tilted forward.

BRIEF DESCRIPTION OF THE DRAWINGS

The above and other features and advantages of the present invention will become further known from the following detailed description when considered in conjunction with the accompanying drawings in which.

DETAILED DESCRIPTION OF PREFERRED EMBODIMENTS

Figure 1:
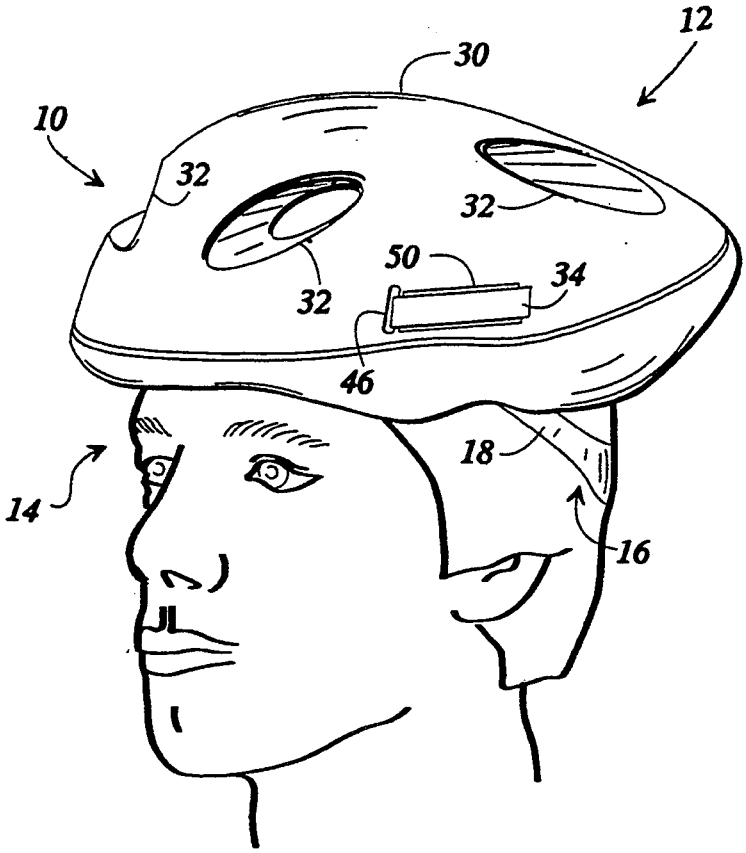
FIG. 1 is a perspective view showing a helmet having a fit system in accordance with the present invention and positioned on the cranium of a user.
Figure 2:
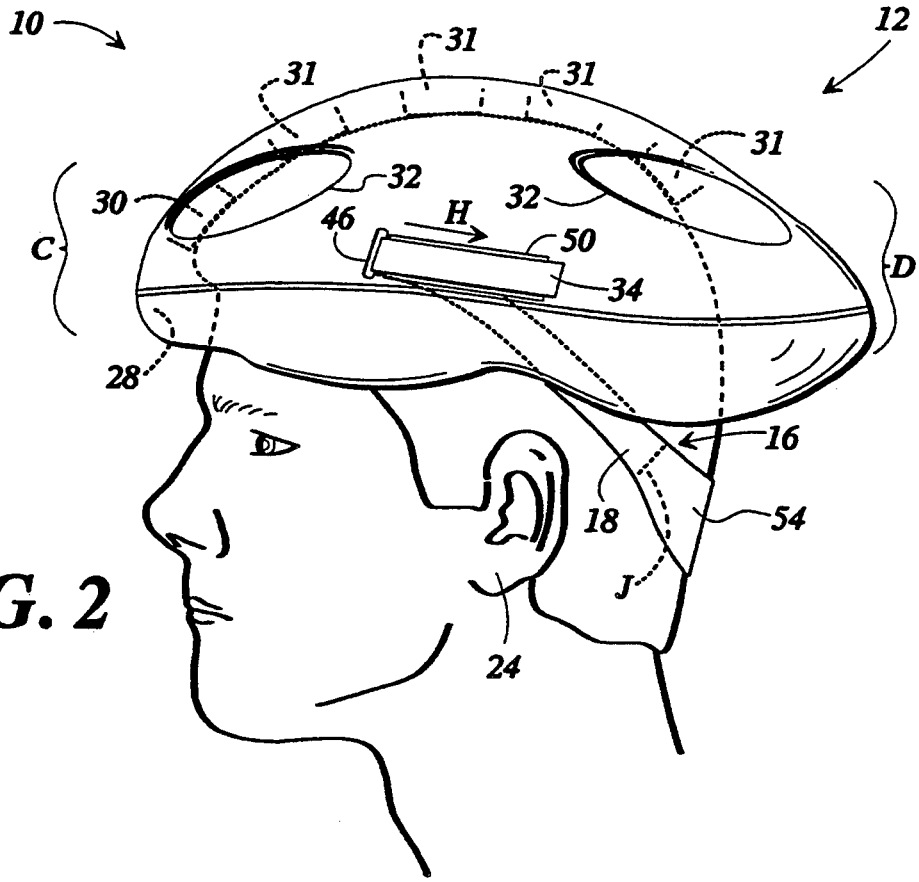
FIG. 2 is a side plan view of the helmet of FIG. 1.

With reference now to the drawings in which like reference characters designate like or similar parts throughout the several views, there is shown in FIGS. 1 and 2 a helmet 10 containing features of the present invention. The helmet 10 includes a helmet liner 12 shown positioned cranium 14 of a user's head. A fit system 16 having an elongate strap 18 is provided with the liner 12 to enable the "fit" of the helmet 10 robe adjusted so that the helmet liner 12 may be snugly positioned on the cranium 14 without the use of interchangeable fit pads.

As used herein, the term "fit" is understood to refer to reduction of slippage between the head or cranium of the user and a helmet and the fit is considered to be poor or unacceptable if a significant amount of slippage is present and a desirable fit is achieved when slippage is minimized and it is comfortable for the user to wear the helmet.

Figure 3:
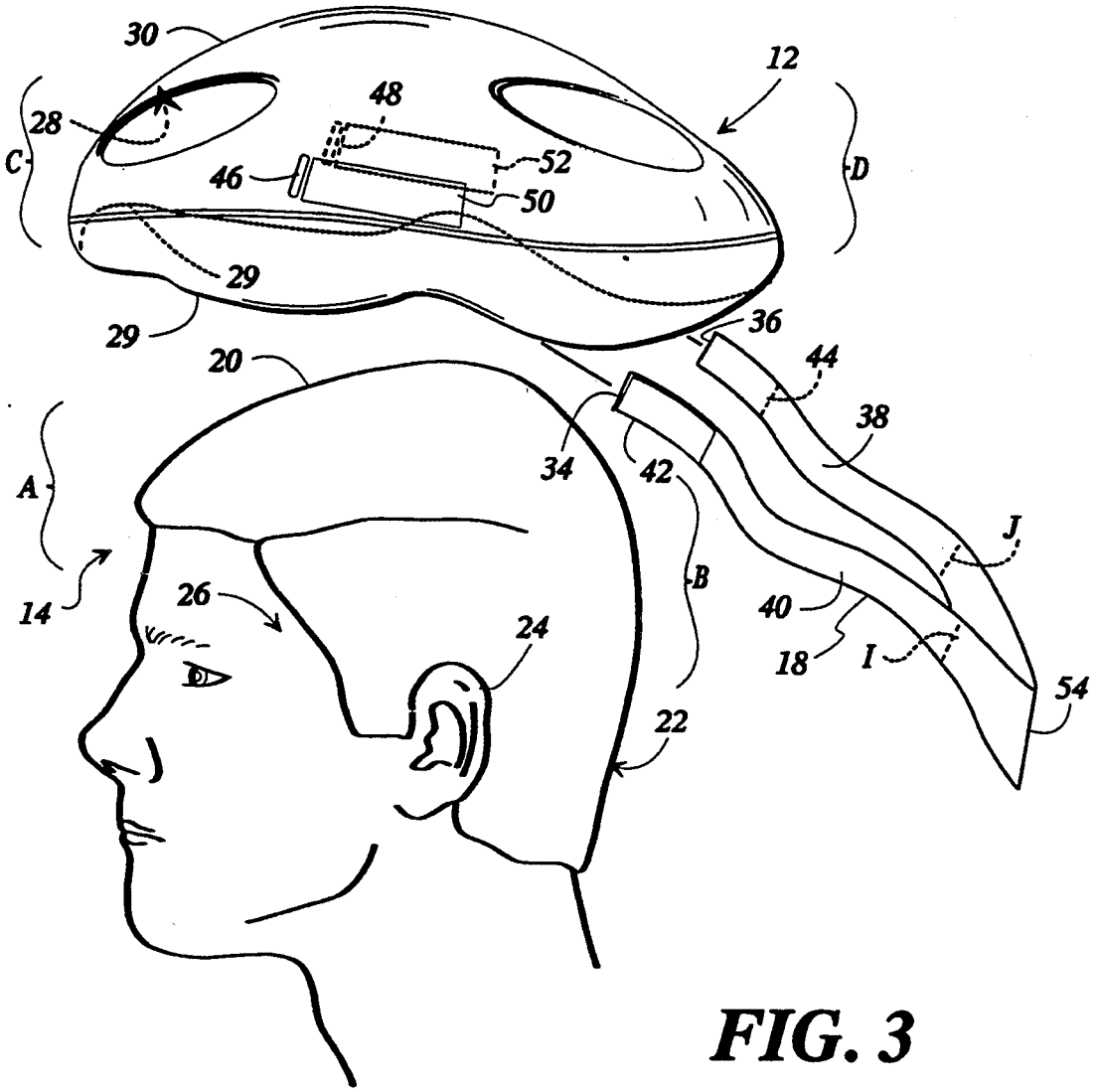
FIG. 3 is an exploded view of the helmet of FIG. 1
Figure 4:
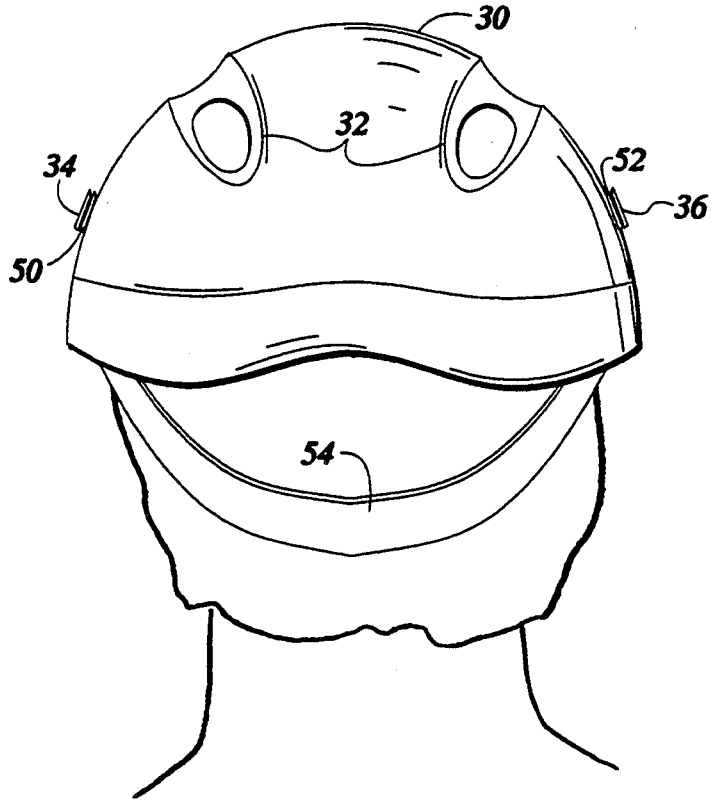
FIG. 4 is a rear view showing the fit system positioned around the occipital protuberance.
Figure 5:
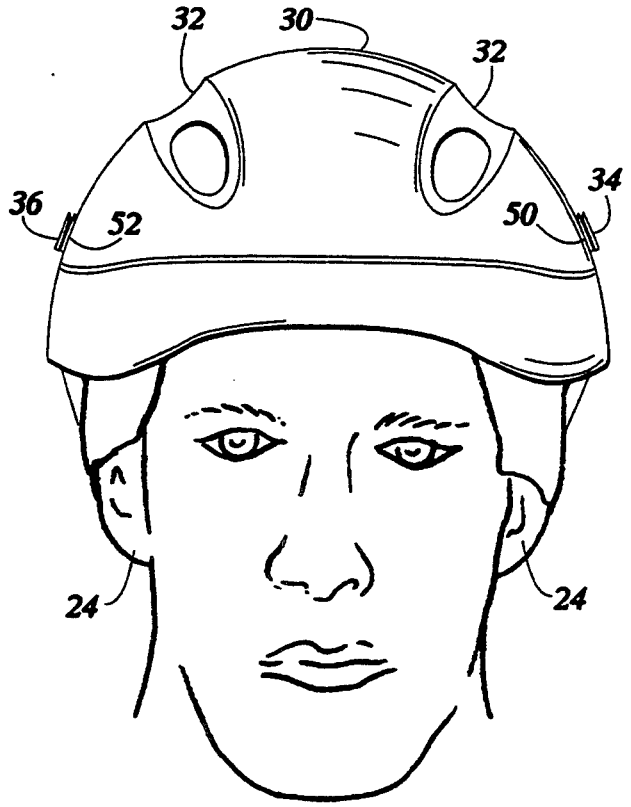
FIG. 5 is a front view of the helmet of FIG. 1.

With additional reference to FIGS. 3, 4, and 5, the cranium 14 of the user's head is a typical human cranium which includes a generally convex crown 20 which defines the uppermost surface of the cranium 14 between front A and back B of the cranium 14 and which also includes a prominent, outwardly protruding bone structure located at the back B of the cranium 14 generally referred to as an occipital protuberance 22. Ears 24 are located on the user's head generally forward of the occipital protuberance 22 on opposite sides of the cranium 14 and temple areas 26 are located generally forward of the ears 24 on opposite sides of the cranium 14.

The helmet liner 12 has a front C and rear D and corresponds generally in size and shape to the crown 20 of the cranium 14. To this end the liner 12 includes a concave, substantially oval inner surface 28 spaced apart by the thickness of the helmet liner 12 from a convex, substantially oval outer surface 30. A plurality of cushioning pads 31 are secured to the inner surface 28 of the liner 12 at desired locations, as by adhesive, to provide cushioning between the inner surface 28 of the liner 12 and the cranium 14. Alternatively, a single, larger cushioning pad (not shown) may be secured to the inner surface 28 to provide the desired cushioning.

Figure 3A:
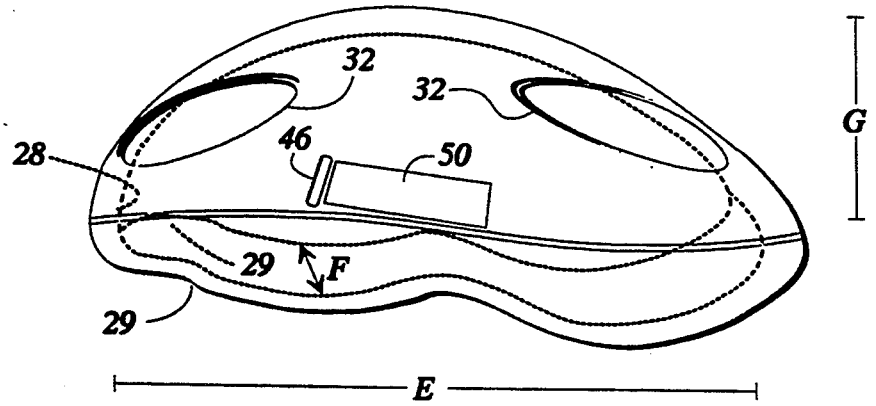
FIG. 3*a* is a detailed view showing the interior of the helmet in phantom.
Figure 6:
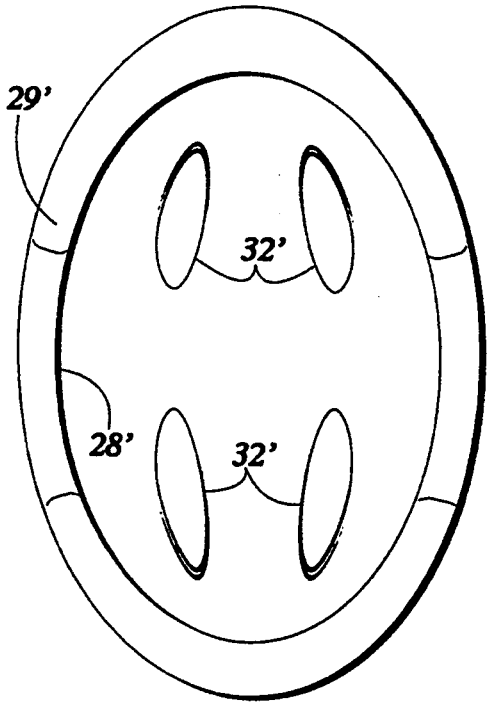
FIG. 6 is a lower elevational view showing the interior of the helmet of FIG. 1.

As best seen in FIGS. 3*a* and 6, the inner surface 28 has a length E which defines the greatest interior length of the liner 12, a width F which defines the greatest interior width of the liner 12, and a height G which corresponds to the greatest vertical distance between lower periphery 29 of the liner 12 and the inner surface 28 of the liner 12. For example, with respect to a helmet liner 12 for a typical size 7 to 7¼ cranium, the length E is preferably about 7.75 inches, the width F is about 6.0 inches and the height G is about 3.25 inches.

When worn on the cranium 14, the helmet 10 is preferably positioned such that the inner surface 28 of the liner 12 overlies the crown 20 of the cranium 14 and the front C and rear D of the liner 12 correspond to the front A and back B of the cranium 14. The cushioning pads 31 substantially prevent the inner surface 28 from contacting the cranium 14 and a desirable fit is achieved when the tension in the strap 18 urges the liner 12, and hence the cushioning pads 31, snugly against the cranium. The height G of the inner surface, as described above, is preferably selected to correspond generally to the vertical distance or height between the temple areas 26 and the crown 20 of the cranium 14 so that the lower periphery 29 of the liner 12 remains a slight vertical distance above the ears 24 when the helmet 10 is worn by the user.

The liner 12 is preferably formed of a lightweight, strong and impact attenuating material, such as expanded polystyrene, and has a substantially uniform thickness of between about 0.25 and 3.0 inches, and preferably between about 0.625 and 1.5 inches. Materials suitable for forming the liner 12 are well known in the art and helmet liners are generally constructed to meet relevant safety criteria. For example, bicycle safety helmets are generally constructed to meet certain established performance criteria such as that established by ANSI, SNELL and/or ASTM.

A plurality of vent openings 32 are preferably provided through the thickness of the helmet liner 12 between the inner liner 28 and the outer liner 30 to permit air to circulate to and from the inner liner 28. In addition, an outer shell (not shown) formed of a hard, preferably colorful, plastic material incorporating a logo or other indicia may optionally be releasably attached, as by mating hook and loop material, or permanently attached, as by in-mold bonding or adhesive, to the outer surface 30 for added durability and aesthetics. The outer shell may also be provided by other types of coverings, such as lycra or other flexible materials. In the event an outer shell is provided by a nonporous material such as hard plastic, it will be understood that the vent openings also preferably extend through the outer shell.

As previously mentioned, the fit system 16 permits the liner 12 of the helmet to be readily "fit" to the cranium 14 without the use of interchangeable fit pads. This is accomplished in one aspect by securing the strap 18 to the outer surface 30 of the liner 12 in such a manner that a portion of the strap 18 snugly engages the occipital protuberance 22, preferably a lower portion of the protuberance, and the strap 18 is tensioned so as to urge the liner 12, and hence the cushioning pads 31, snugly against the cranium to provide the desired fit.

To this end the elongate strap 18 of the fit system 16 includes a pair of opposed ends 34 and 36, and an interior side 38 and an exterior side 40. The strap 18 is preferably provided by a conformable material, such as tubular nylon webbing. The strap 18 preferably has a length of between about 18 and 30 inches and a width of between about 0.375 and 1.5 inches. Strips of loop material 42 and 44 are preferably attached, as by lamination or thread, to the ends 34 and 36, respectively, adjacent the exterior side 40 of the strap 18. Each strip of loop material 42 and 44 preferably has a length of about 3 inches for attaching the ends 34 and 36 of the strap 18 to the outer surface 30 of the helmet liner 12 as explained below.

To permit installation of the strap 18 onto the liner 12, the helmet liner 12 in one embodiment includes a pair of generally oblong shaped openings 46 and 48 which extend between the inner surface 28 and the outer surface 30 of the liner 12 for slidably receiving the strap 18. The openings 46 and 48 are located on opposite sides of the helmet liner 12 so that they are situated slightly above the temple areas 26 of the cranium 14 when the helmet 10 is worn by the user. Hook material 50 and 52 secures, as by adhesive, to the outer surface 30 of the helmet liner 12 for mating with the strips of loop material 42 and 44. If desired, indentations (not shown) may be provided on the outer surface 30 to serve as channels for receiving the hook material and for guiding the strap 18.

The helmet 10 may be pre-assembled prior to being placed on the cranium 14 by inserting the ends 34 and 36 of the strap 18 through the openings 46 and 48, respectively, in a direction away from the inner surface 28 and toward the outer surface 30 of the liner 12. The loop material 42 and 44 of the ends 34 and 36 is then mated with the hook material 50 and 52, respectively, to prevent the ends from passing back through the openings 46 and 48. The ends 34 and 36 are preferably initially secured with the strap 18 set at maximum length to permit the strap 18 to fit over the cranium. The assembled helmet 10 may then be placed upon the cranium 14 of the user and positioned on the cranium 14 in the manner previously discussed.

When the helmet 10 is positioned on the cranium 14, the interior side 38 of the strap 18 is adjacent the cranium 14 and the strap 18 extends from the occipital protuberance 22 to the openings 46 and 48. Thus, as referenced from the occipital protuberance 22, the strap 18 extends bilaterally above the ear 24 and forward to just above the temple area 26 on each side of the cranium 14.

To "fit" the helmet 10 to the cranium 14, the user grasps each of ends 34 and 36, preferably simultaneously, and frees them from contact with the hook material 50 and 52. The user then exerts force on the free ends 34 and 36 in a direction generally away from the outer surface 30 and toward the back D of the helmet, as indicated by the arrow H (FIG. 2), to tension the strap 18 so that a middle portion 54 of the strap 18 (located generally between points I and J) snugly engages the cranium on or below the occipital protuberance 22, and preferably engages the lowermost portion of the occipital protuberance 22, so that the resulting tension in the strap 18 urges at least a portion of the liner 12, and preferably those portions corresponding to the locations of the cushioning pads 31, snugly against the cranium to provide the desired fit. Once the desired snugness is achieved, the ends 34 and 36 are returned to engagement with the hook material 50 and 52 to maintain the middle portion in snug engagement with the occipital protuberance 22 and to maintain the desired tension to the strap 18. To remove the helmet 10, the strap 18 is released from tension by releasing the ends 34 and 36 from engagement with the hook material 50 and 52. The helmet 10 may then lifted upwardly and away from the cranium 14.

As described previously, an optional outer shell may be provided over the liner 30. In this event, it will be understood that the indentations described above may also be provided on the outer shell and that the hook material may be secured to the outer shell. Also, it will be understood that if a lycra covering is provided as described previously, openings may be provided therethrough to permit access to the hook material on the outer surface 30.

Accordingly, it will be appreciated that the fit system 16 enables the fit of the helmet 10 to be easily and quickly adjusted without the use of interchangeable fit pads. In addition to this advantage, the positioning of the strap 18 snugly against the occipital protuberance 22 is also advantageous to help retain the helmet 10 snugly against the cranium 14 even when the cranium 14 is tilted forward.

The fit system of the present invention is preferably used in combination with a retention system to help maintain the helmet 10 on the cranium 14 during a fall or collision. This aspect of the present invention will be discussed more fully below, in connection with FIGS. 13, 14, **14*a* and 15**.

Figure 7:
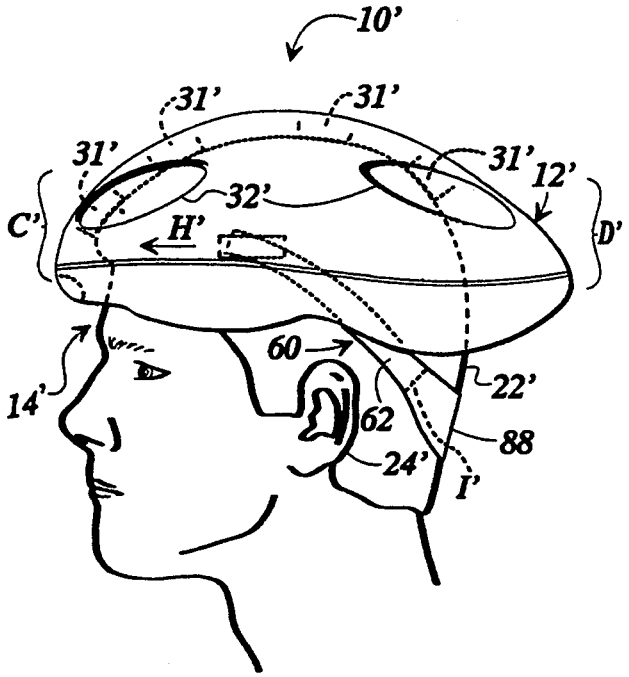
FIG. 7 is a side plan view showing another embodiment of a fit system for fitting a helmet to the cranium of a user.
Figure 8:
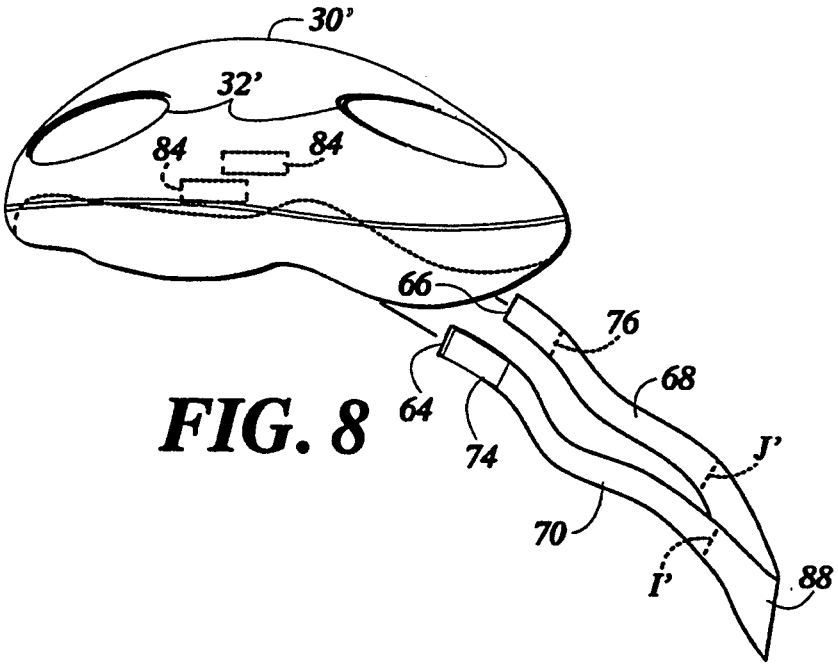
FIG. 8 is an exploded view of the helmet of FIG. 7.

Turning now to FIGS. 7 and 8, there is shown another embodiment of a helmet 10' provided in accordance with the present invention. In this embodiment, the fit system is of a type which may readily be used with an existing helmet. For ease of reference, elements corresponding to previously described elements will be referenced with the same characters using a prime suffix.

The helmet 10' includes a liner 12' positioned on cranium 14' of a user. A fit system 60 having an elongate strap 62 is provided for a liner 12' to enable the fit of the helmet 10' to be adjusted so that the helmet liner 12' may be snugly positioned on the cranium 14' without the use of interchangeable fit pads. This is accomplished by securing the strap 62 to inner surface 28' of the liner 12' so that the strap 62 snugly engages the occipital protuberance 22', as will be explained more fully below.

Figure 9:
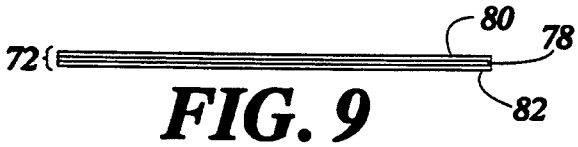
FIG. 9 is a partial cross-sectional view of the fit system of FIG. 7.

The elongate strap 62 is generally rectangular in shape and includes a pair of opposed ends 64 and 66, and an interior side 68 and an exterior side 70. The strap 62 is preferably provided by a conformable laminate material 72 having a length of between about 18 and 24 inches, a width of about $\frac{5}{8}$ inch and a thickness of between about 0.08 inches to about 0.25 inches. Strips of loop material 74 and 76 are preferably attached, as by stitches, to the ends 64 and 66, respectively, on the exterior side 70 of the strap 62. Each strip of loop material 74 and 76 preferably has a length of about 3 inches for attaching the ends 64 and 66 to the inner surface 28' of the liner 12', as explained below. With reference to FIG. 9 the laminate material 72 is preferably provided by a strip of neoprene 78 laminated to brushed nylon 80 on one side and stretch lycra 82 on the other side. However, it will be understood that for each of the described embodiments, either of the described strap materials, as well as other suitable materials, may be used. When the laminate material is used, it is preferred for comfort purposes to position the stretch lycra 82 so that it faces the head of the user when the strap is installed on the helmet.

To accomplish installation of the strap 72 onto the liner 12', the liner in one embodiment includes strips of hook material 84 and 86 secured, as by adhesive, to inner surface 28' of the liner 12' for mating with the strips of loop material 74 and 76. The strips of hook material 84 and 86 are preferably secured to the inner surface 28' just slightly above periphery 29' of the liner 12'. Accordingly, it will be appreciated that in this embodiment openings such as the openings 46 and 48 of the embodiment of FIG. 1 are preferably not provided through the liner and the helmet may be provided with the fit system 60 without significant modification.

To "fit" the helmet 10' to the cranium 14', the user grasps each of the ends 64 and 66 and exerts force thereon in a direction toward the front C' of the helmet, as indicated by the arrow H', to tension the strap 62 until a middle portion 88 of the strap 62 (located generally between points I' and J') snugly engages the occipital protuberance 22' and the tension in the strap 62 urges the liner 12', and hence the cushioning pads 31', snugly against the cranium 14' to provide the desired fit. Once the desired snugness is achieved, the strips of loop material 74 and 76 of the ends 64 and 66 are mated with the hook material 84 and 86, respectively, to secure the strap to the inner surface 28' of the liner 12' in a tensioned state so that the middle portion 88 of the strap 62 is maintained in snug engagement with the occipital protuberance 22'. Because the brushed nylon 80 has a texture which is suitable for mating with the hook material 84 and 86, the loop material 74 and 76 may be omitted and the brushed nylon 80 adjacent the ends of the strap 62 can be mated with the hook material. To customize the fit system 60 to an individual user, the length of the strap 62 may be adjusted, as by cutting, once the desired fit is achieved.

To remove the helmet 10', the helmet may be rocked rearward in an arc and the helmet 10' lifted upwardly and away from the cranium 14'. Accordingly, it will be appreciated that the ends 64 and 66 need not be released from the hook material 84 and 86 for removal or re-installation of the helmet, since the stretch of the material 72 permits removal and re-installation of the helmet without re-adjustment.

As will be appreciated, the fit system 62 enables the fit of the helmet 10' to be easily and quickly adjusted without the use of interchangeable fit or sizing pads. In addition, the fit system 60 may be easily and quickly installed on existing helmets without requiring significant modification of the helmet, since all that is required is the provision of attachment devices, such as the strips of hook material 84 and 86, on the inner liner 28' of the helmet.

Figure 10:
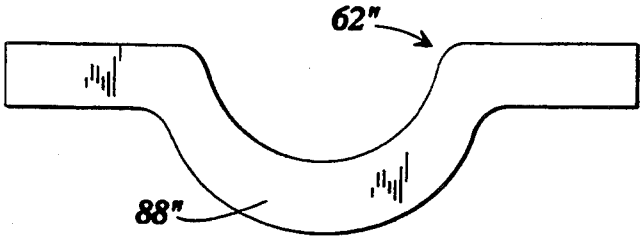
FIG. 10 is a top plan view of another embodiment of the fit system of FIG. 7.
Figure 11:
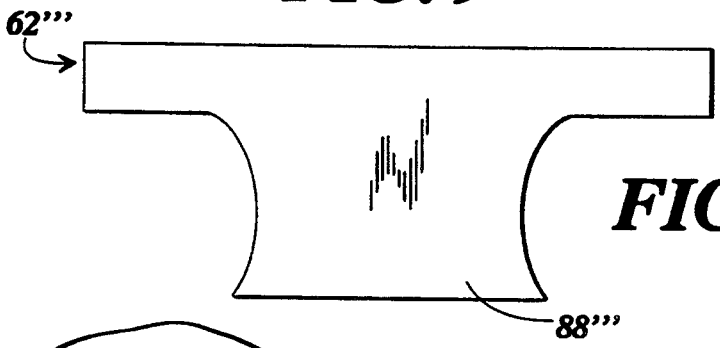
FIG. 11 is a top plan view of still another embodiment of a fit system of FIG. 7.
Figure 12:
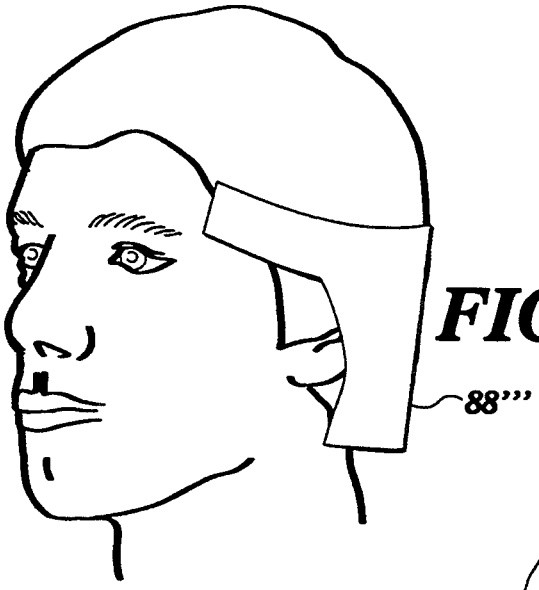
FIG. 12 is a perspective view showing the fit system of FIG. 11 positioned on the head of a user.

With reference to FIGS. 10, 11 and 12, there are shown additional embodiments of straps which are useful for providing the strap 62. In addition, it will be understood that features of these embodiments may also be incorporated into the strap 18. Elements corresponding to previously described elements will be referenced with the same characters using double and triple prime suffixes.

In FIG. 10, there is shown a strap 62" preferably formed of the laminate material 72 and including a middle portion 88" of generally U-shaped configuration which conforms closely to the shape of the occipital protuberance 22'. The middle portion 88" may be trimmed by the user to conform closely to the actual shape of the occipital protuberance of the user so that the middle portion 88" snugly grips the occipital protuberance when the strap 62" is tensioned the desired amount.

FIGS. 11 and 12 show a strap 62''' having an expanded middle portion 88''' which not only covers the occipital protuberance, but also covers the ears and the neck of the user during use. This embodiment is particularly suitable for cold weather use to protect the back of the cranium, neck and the ears of the user from exposure to wind and cold. In this embodiment, the use of the laminate material is particularly desired, since the neoprene 78 has insulating qualities.

Figure 13:
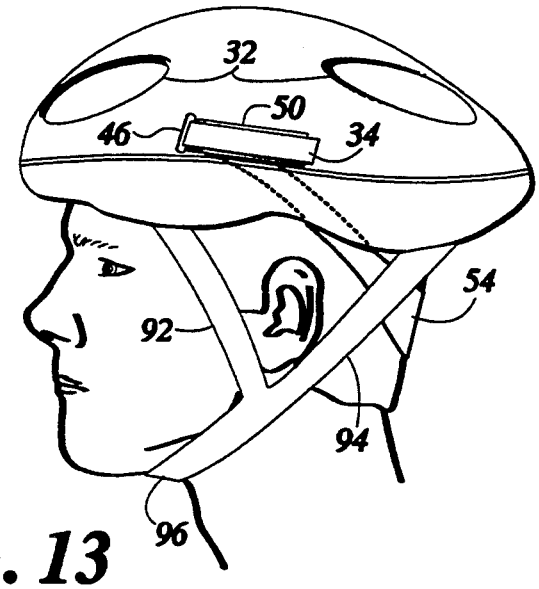
FIG. 13 is a side plan view showing a helmet having a fit system in accordance with the present invention and a conventional retention system.

As mentioned previously, the fit system of the present invention is preferably used in combination with a retention system to help maintain the helmet on the cranium 14 during a fall or collision. In this connection, FIG. 13 shows the helmet 10 of FIG. 1 further including a conventional retention system 90 having elongate retention straps 92 and 94 and a buckle 96 which buckles the free ends of the strap 92 together so that the strap 92 may be snugly secured against chin 98 of the user's head.

The retention straps 92 and 94 of the retention system 90 are shown positioned around the forward portion of the outer surface 30. Retention systems of this type are well known in the art and the straps 92 and 94 are positioned around the outer surface 30 in a conventional manner. Alternatively, if an outer shell is present, as previously discussed in connection with FIG. 1, and as can be appreciated upon reference to FIG. 13, the straps 92 and 94 may be positioned between the shell and the surface 30 so that they are concealed for aesthetics.

It has been experienced, however, that conventional retention systems are often difficult to adjust and uncomfortable and therefore desire improvement. Accordingly, the present invention further provides improved retention systems which are easier to use and are more comfortable than conventional retention systems. To this end, FIGS. 14, 14*a* and 15 show preferred embodiments of retention systems provided in accordance with further aspects of the present invention.

Figure 14:
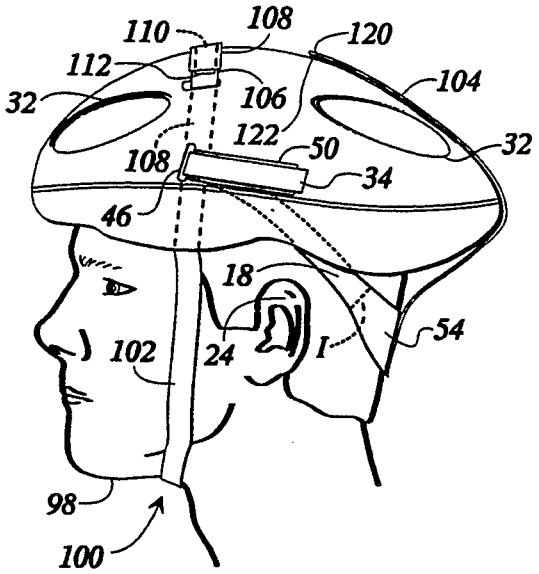
FIG. 14 is a side plan view of a helmet having a fit system and a retention system in accordance with the present invention and FIG. 14*a* is a top plan view of the helmet of FIG. 14.
Figure 14A:
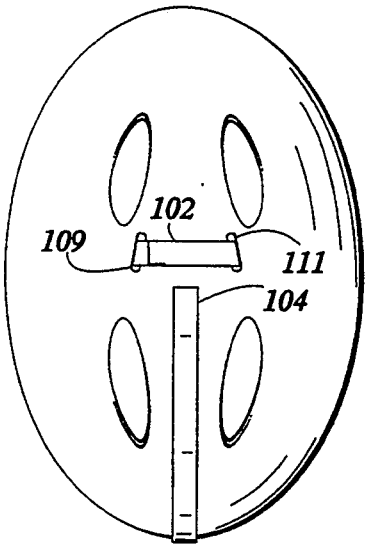
Figure 15:
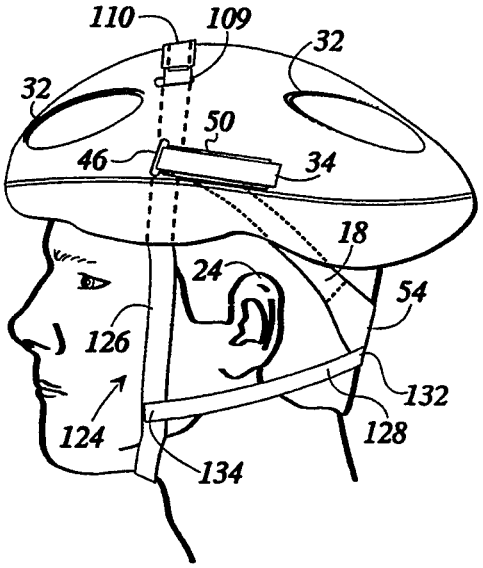
FIG. 15 is a left-side view of another helmet having a fit system and a retention system in accordance with the present invention and FIG. 15*a* is a right-side view.

FIGS. 14 and 14*a* show the helmet 10 of FIG. 1 equipped with a retention system 100 having elongate retention straps 102 and 104. The strap 102 is positioned around the chin 98 of the user and the outer surface 30 (or optional shell) of the helmet and the ends of the strap 102 are secured to one another by mating hook and loop material. One end of the strap 104 is attached, as by stitches, to the middle portion 54 of the strap 18 and the other end is secured to the outer surface 30, as by mating hook and loop material.

In one embodiment, the retention strap 102 includes a pair of opposed ends 106 and 108. The strap 12 is preferably provided by tubular nylon webbing having a length of between about 19 and 26 inches. A strip of loop material 110 is preferably attached, as by lamination or thread, to the end 106 and a mating strip of hook material 112 is preferably attached to the end 108. The strip of loop material 110 and the strip of hook material 112 preferably each have a length of between about 3 and 6 inches for attaching the ends 106 and 108 together in a mating relationship adjacent the outer surface 30 of the helmet liner 12.

The strap 102 is positioned to overlie the outer liner 30, with the ends 106 and 108 preferably positioned adjacent the outer surface 30 in a mating relationship, and extending downwardly through openings 109 and 111 as shown in FIG. 14*a*. Alternatively, the strap 102 may extend through the vent openings 32. To ready the strap 102 for use, the user separates the ends 106 and 108 and positions the strap 102 around the chin 98. The ends 106 and 108 are then pulled upwardly toward one another until the strap 102 is tightly against the chin 98, and the ends 106 and 108 overlap. The ends 106 and 108 are then re-mated to maintain the strap 102 tightly against the chin 98 and the outer surface 30 of the liner 12.

The strap 104 is preferably provided by tubular nylon webbing having a length of between about 12 and 18 inches and includes a pair of opposed ends 116 and 118. The end 116 is attached, as by stitches to the middle portion 54 of the strap 18 and a strip of loop material 120 is attached, as by lamination or stitches, to the end 118. A mating strip of hook material 122 is preferably attached, as by adhesive, to the outer surface 30 for mating with the strip of loop material 120.

The strap 104 is positioned to extend from the middle portion 54 of the strap 18 to the top of the outer surface 30, as shown in FIG. 14. To ready the strap 104 for use, the user exerts force on the end 118 of the strap 104 in a generally upward and forward direction until a desired tension is imparted to the strap 104. The end 118 is then secured to the outer surface 30 (or optional shell)

by mating the loop material 120 to the hook material 122 to maintain the strap 104 tightly against the outer surface 30.

Figure 15A:
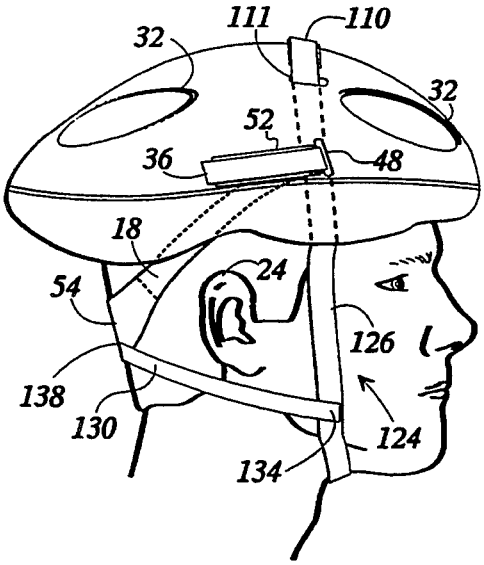

In accordance with a further embodiment of the present invention, FIGS. 15 and 15*a* show the helmet 10 having a retention system 124 which includes a retention strap 126 and retention straps 128 and 130. The strap 126 is identical to the strap 102 and is positioned around the chin 98 of the user and the outer surface 30 of the helmet and the ends secured to one another by mating hook and loop material. The straps 128 and 130 extend between the strap 18 and the strap 126 on opposite sides of the helmet.

The straps 128 and 130 are identical to one another and are preferably provided by tubular nylon webbing having a length of between about 3 and 8 inches. Alternatively, the straps 128 and 130 may also be sewn together or may be provided by a single length of material having a length of between about 6 and 16 inches and centrally anchored to the strap 126. Strap 128 includes a pair of opposed ends 132 and 134 and the strap 130 includes opposed ends 136 and 138. The ends 132 and 134 attach, as by stitches, to the strap 18 and the strap 126, respectively, on opposite sides of the cranium 14 so that the strap 128 extends between the strap 18 and the retention strap 126 as shown. Similarly, on the opposite side of the cranium from the strap 128, the straps ends 136 and 138 attach to the strap 18 and the strap 126, respectively, so that the strap 130 extends between the strap 18 and the retention strap 126.

In the event of a collision or fall, the retention system 100 and 124 help to maintain the helmet on the cranium. The retention systems 100 and 124 are also more easily adjusted and comfortable than conventional retention systems. For example, the mating hook and loop material enables quick and easy adjustment and also eliminates the need for a buckle, such as the buckle 96 shown in the embodiment of FIG. 13, which can rub against and chafe the chin of the user. For improved comfort, an optional pad (not shown) maybe attached to the straps 102 and 126 for contacting the chin. In addition, the mating hook and loop material may be configured so as to release at a desired threshold. This feature is advantageous to permit the hook and loop material to release under certain conditions, such as when the helmet becomes hung on an obstruction.

As will be appreciated from the foregoing detailed description, the present invention provides a fitting system which facilitates fitting of headgear to heads of various size and shape without requiring interchangeable fit pads of various thicknesses. For example, by simply adjusting the tension of the strap about the occipital protuberance, the user may adjust the fit of the helmet. Thus, the fit of the helmet may be adjusted easily and quickly regardless of the shape of the user's head. In addition, the fit system may be easily installed on existing helmets by simply installing attachment devices, such as hook material, on the interior of the helmet.

The present invention also provides a combination fitting and retention system which is easy to adjust and comfortable and which is inexpensive and uncomplicated in configuration. For example, the use of a cumbersome and uncomfortable buckle system is eliminated by providing a retention system which attaches to the fit system and which is adjusted by simply mating hook and loop material.

The foregoing description of preferred embodiments of the present invention has been provided for purposes of illustration only, and it is understood that numerous modifications or alterations may be made without departing from the spirit and scope of the invention as defined in the following claims.

What is claimed is:

1. A helmet for wearing on a user's head having a chin and a cranium having an occipital protuberance and a crown, said helmet comprising:

a liner having an inner surface corresponding substantially in size and shape to the crown of the cranium;

elongate fitting means for fitting the liner to the cranium, said fitting means having a middle portion and a pair of opposed ends;

attachment means for attaching the opposed ends of said fitting means closely adjacent to said liner to maintain said fitting means in a tensioned state so that said middle portion of said fitting means fittingly engages at least a portion of the cranium on or below the occipital protuberance of the cranium and the tension in said fitting means maintains the inner surface of said liner closely adjacent the cranium; and retention means for maintaining the liner adjacent to the cranium, said retention means comprises a first elongate retention strap and releasable fastening means for releasably positioning the retention strap to surround the chin of the user's head and at least a portion of the liner, and a second elongate retention strap connected to said fitting means.

2. The helmet of claim 1, wherein said second elongate strap includes a first end connected to said fitting means and a second end connected to said first retention strap.

3. The helmet of claim 1, wherein said helmet includes an outer surface spaced apart from said inner surface and said second elongate strap includes a first end connected to said fitting means and a second end releasably attachable to the outer surface.

4. A system for fitting headgear to a cranium having temple areas and an occipital protuberance, the headgear having an interior surface, an exterior surface and opposite sides positionable adjacent the temple areas of the cranium, said system comprising:

elongate, tensionable fitting means for fitting the headgear to the cranium, said fitting means comprising an elongate strip of tubular nylon webbing having a middle portion and a pair of opposed ends; and attachment means for attaching the opposed ends of said fitting means to said headgear to maintain said fitting means in a tensioned state so that said middle portion of said fitting means fittingly engages at least a portion of the cranium on or below the occipital protuberance of the cranium and the tension in said fitting means maintains at least a portion of the headgear closely adjacent the cranium, wherein said attachment means comprises releasable fastening means for releasably fastening the opposed ends of said fitting means to opposite sides of the helmet so that said fitting means may be tensioned to urge the middle portion of the fitting means snugly against the occipital protuberance, wherein said fastening means comprises mating hook and loop material, said loop material being provided on the opposed ends and the hook material being positionable on the interior surface of the headgear.

* * * * *